United States Patent [19]

Young et al.

[11] 4,356,923

[45] Nov. 2, 1982

[54] STORAGE AND DISPENSING RACK

[75] Inventors: Raymond R. Young, Glenview; Russell M. Barnes, Bloomingdale; Donald W. Wendel, Mt. Prospect, all of Ill.

[73] Assignee: Visual Marketing, Inc., Chicago, Ill.

[21] Appl. No.: 152,301

[22] Filed: May 22, 1980

[51] Int. Cl.[3] ..... A47F 7/00

[52] U.S. Cl. ..... 211/49 D; 211/184; 312/45

[58] Field of Search ..... 211/49 D, 184; 312/45, 312/72

[56] References Cited

U.S. PATENT DOCUMENTS

| | | | |
|---|---|---|---|
| 1,673,812 | 6/1928 | Dunn | 211/49 D X |
| 1,711,329 | 4/1929 | Short | 211/49 D X |
| 2,119,700 | 6/1938 | Burgess | 211/49 |
| 2,122,322 | 6/1938 | Kidwell et al. | 211/49 |
| 2,125,000 | 7/1938 | Considine | 211/49 |
| 2,125,557 | 8/1938 | Goldman | 211/74 |
| 2,149,821 | 3/1939 | Sutherland | 211/114 |
| 2,218,444 | 10/1940 | Vineyard | 211/49 |
| 2,289,751 | 7/1942 | Brenholt | 211/49 |
| 2,408,380 | 10/1946 | Dennis | 312/48 |
| 2,492,912 | 12/1949 | Womack | 312/45 |
| 2,588,618 | 3/1952 | Di Renzo | 312/49 |
| 2,888,145 | 5/1959 | Knott et al. | 211/49 D |
| 2,901,118 | 8/1959 | Beesley | 211/49 |
| 2,905,330 | 9/1959 | Lilja | 211/49 |
| 2,934,212 | 4/1960 | Jacobson | 211/49 |
| 2,958,424 | 11/1960 | Bigatti | 211/41 |
| 3,007,580 | 11/1961 | Dickson | 211/49 |
| 3,019,907 | 2/1962 | Belejack | 211/49 |
| 3,152,697 | 10/1964 | Berman et al. | 211/49 D |
| 3,194,620 | 7/1965 | Saver | 312/45 |
| 3,203,553 | 8/1965 | Pendergrast et al. | 211/49 |
| 3,203,554 | 8/1965 | Pendergrast et al. | 211/49 |
| 3,286,846 | 11/1966 | Brandes | 211/49 |
| 3,298,763 | 1/1967 | Di Domenico | 312/45 |
| 3,304,141 | 2/1967 | Rogers | 312/45 |
| 3,306,688 | 2/1967 | Domenico | 312/42 |
| 3,393,808 | 7/1968 | Chirchill | 211/49 D |
| 3,404,927 | 10/1968 | Mellion | 312/45 |
| 3,499,539 | 3/1970 | Fisher | 211/49 |
| 3,606,022 | 9/1971 | Beesley | 211/49 D |
| 3,784,022 | 1/1974 | Beesley | 211/49 D |
| 3,805,964 | 4/1974 | Titus | 211/49 D |
| 4,105,126 | 8/1978 | Deffner et al. | 211/49 D |
| 4,228,903 | 10/1980 | Eckert | 211/194 X |

FOREIGN PATENT DOCUMENTS 1456468 10/1966 France .

*Primary Examiner*—Ernest R. Purser
*Attorney, Agent, or Firm*—Hume, Clement, Brinks, Willian & Olds, Ltd.

[57] ABSTRACT

A rack for storing and dispensing individual containers of generally cylindrical shape, comprising at least two identical side members, each side member including a plurality of apertures in paired, adjacent relationship and at least one pair of support tracks, each pair of support tracks being positioned at the same vertical location on opposite sides of the side member, and rods, each rod being removably received by an independent pair of parallel apertures and interconnecting the side members at a plurality of locations whereby said support tracks cooperate to support the containers along an incline.

11 Claims, 6 Drawing Figures

STORAGE AND DISPENSING RACK

BACKGROUND OF THE INVENTION

The invention relates generally to storage and dispensing apparatus such as used, for example, in supermarkets, merchandising establishments, and storage areas in recreation rooms. More particularly, the present invention is directed to an improved modular rack for storing and dispensing cans and other generally cylindrically shaped containers, that permits easy assembly and disassembly of the rack. Such cases or containers may hold, for instance, soft drinks, beer, soup, vegetables, refrigerated dough, and the like. According to one embodiment of the present invention, a single rack accommodates cans of more than one size, to be dispensed in spaced side-by-side relationship.

Storage and dispensing racks for cans and other cylindrical containers are known in the art. Modular racks, for instance, are disclosed in U.S. Pat. Nos. 4,105,126 (assigned to the assignee of the present invention), 3,393,808, 3,152,697 and 2,888,145. U.S. Pat. No. 4,105,126 discloses a fully modular rack comprised of side walls and separate shelves. U.S. Pat. No. 3,393,808 discloses an adjustable modular rack requiring a plurality of small support members to incline a shelf properly. U.S. Pat. No. 3,152,697 discloses a modular dispensing display rack comprising preassembled identical shelf and side wall units which are bolted together in modular form. U.S. Pat. No. 2,888,145 also discloses a dispenser with side walls bolted together, but not all the side walls therein are identical.

These prior art storage and dispensing racks all are designed to achieve specific advantages and objects, and each is rather complex as a result. Either a number of elements is required for the flexibility or strength sought in the prior art units, or an abundance of material is required, making the units costly to fabricate and expensive to ship and assemble. Some of the prior art racks, such as disclosed in U.S. Pat. No. 3,152,697, although modular in form, are partially assembled at the point of manufacturing and therefore require greater amounts of space during storage and shipment than they would require if shipped unassembled. Other racks are not designed to accommodate cans of different sizes in side-by-side adjacent relationship, to identify the type of can and its contents with a device that is handy but easily moves out of the user's way, or to be easily assembled, disassembled or modified with a minimal number of parts.

SUMMARY OF THE INVENTION

The present invention is directed to an apparatus for storing and dispensing cans or other cylindrical objects which overcomes the disadvantages of the prior art apparatus. The rack is comprised of at least two identical side members, and rods interconnecting the side members. Each side member has at least one pair of support tracks, each pair of support tracks being positioned at the same vertical location on opposite sides of the side member. Once the rods are inserted into apertures in the side members, they combine with the side members to provide a stable rack constructed from a relatively small number of parts. Costs of manufacture are reduced over the prior art not only by the fully modular design but also by the reduction in raw material required to produce the components of the rack.

According to further preferred embodiments, two, three, or four different rod lengths are provided. In that way a number of side members can be used with different sets of rods to produce a series of shelves in side-by-side adjacent relationship accommodating cans of different heights. The standard can sizes are 8 ounces, 12 ounces and 16 ounces. The embodiment depicted in the drawings relates to a rack to store and display 12-ounce and 16-ounce cans, such as beer cans. Because a 12-ounce beer can may be slightly taller than the standard 12-ounce soft drink can, a further embodiment of the present invention provides rods of three different lengths so that shelves of three different widths for the three can types can be constructed. According to a still further embodiment of the invention, a rod of a shorter length is provided to accommodate 8-ounce cans.

In addition to reduction of manufacturing costs, advantages of the present invention include the following: the number of components required to produce a rack is small, and the only large components are the side members, thus permitting a disassembled rack to be stored or shipped in a rather compact arrangement. The rods have, instead of threaded ends, tapered tips that snap into an aperture in the side member for easy assembly and disassembly of the rack, particularly at the point of sale of the displayed product. Furthermore, in one embodiment, lightweight identification flaps are provided, which swing out of a user's way when the rack is filled or emptied, yet clearly identify the product in the adjacent shelf space.

A further advantage is that the open arrangement of side members of the present invention and the absence of a solid shelf piece extending completely between the side members better displays the cans to the user or consumer. The rack is also designed so that cans and other containers can be placed on the individual shelf areas from either the front or the back of the rack, and stops are provided at the front and back to insure proper display of the cans without their inadvertently rolling off the shelf.

BRIEF DESCRIPTION OF THE DRAWINGS

The invention itself, together with further objects and advantages, is best understood by reference to the following description taken in connection with the accompanying drawings, in which.

DETAILED DESCRIPTION OF THE PREFERRED EMBODIMENTS

Figure 1:
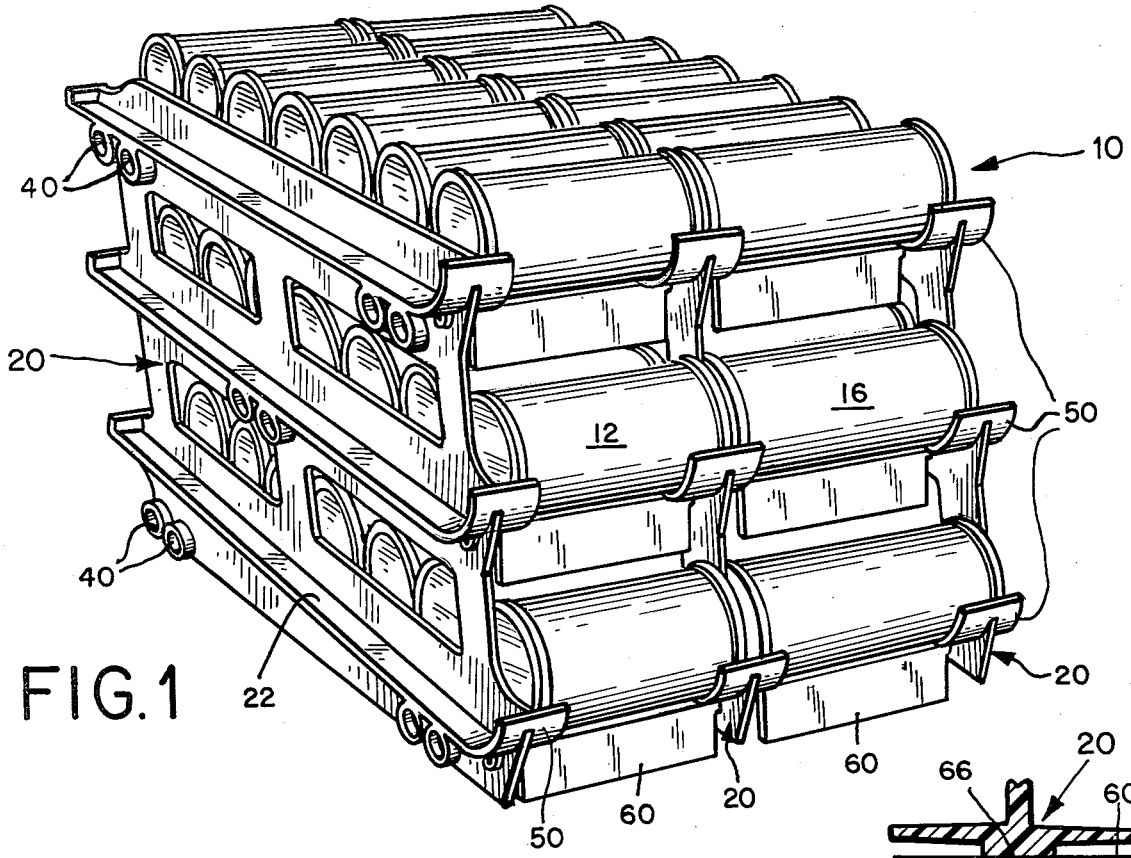
FIG. 1 is a perspective view illustrating one preferred embodiment of the storage and dispensing rack of the present invention.
Figure 5:
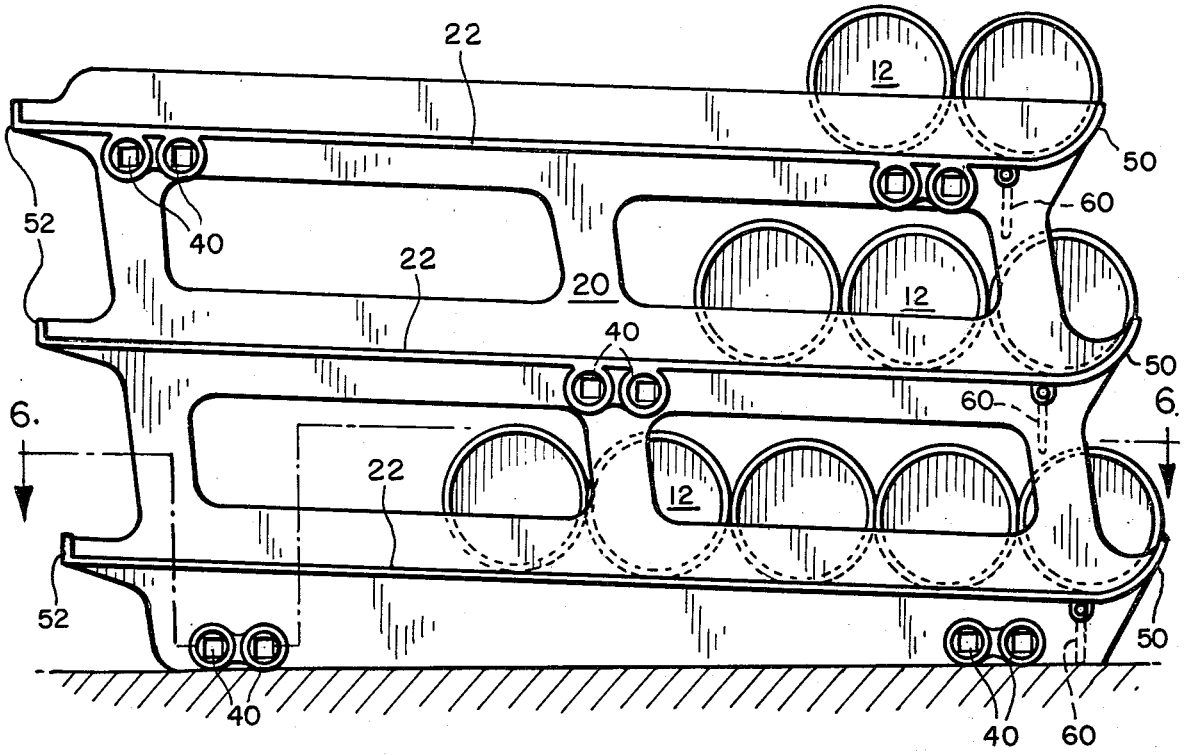
FIG. 5 is a side elevation view of the storage and dispensing rack of FIG. 1, showing the configuration of the side members, including the location of apertures for receiving interconnecting rods.
Figure 6:
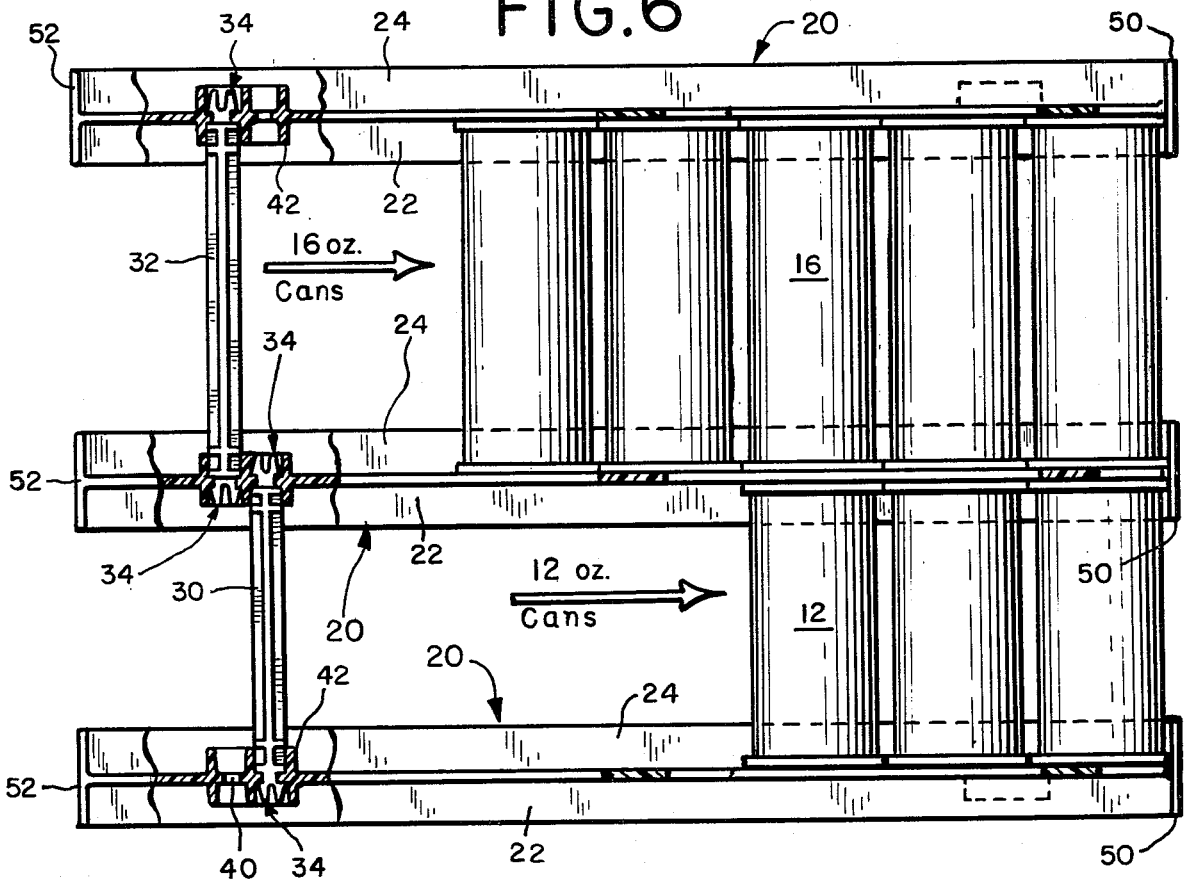
FIG. 6 is a top cross-sectional view of the storage and dispensing rack of FIG. 5 taken along line 6—6, and showing the relative sizes of interconnecting rods and cans accommodated in the two side-by-side shelf portions of the embodiment therein.

Referring now to the drawings, and more particularly to FIGS. 1, 5, and 6, there is illustrated a preferred embodiment of the storage and dispensing rack 10 of the present invention, having a plurality of side members 20 and interconnecting rods 30 and 32. The storage and dispensing rack 10 is designed to accommodate in one shelf array a series of small cans 12 of the 12-ounce size, and larger cans 16 of the 16-ounce size. As will be described in greater detail below, the support members 20 and the rods 30 or 32 are the only components necessary in the assembly of the rack 10, and they may be used repetitively to form any number of multi-tiered storage and dispensing racks joined in side-by-side arrangement. In fact, other lengths of rods may be used to accommodate different-sized cans of generally standard dimension.

In the preferred embodiment shown in the drawings, two sets of shelves are provided. The shelves accommodate the two different types of cans 12 and 16 on an incline and present them for dispensing at a forward end of the rack as in FIG. 1. The incline is represented in the direction of the arrows in FIG. 6.

Each side member 20 has a plurality of pairs of support tracks 22 and 24, each pair having a support track on both sides of the side member 20 at the same vertical location. For instance, support track 22 on one side of the side member 20 is at the same location as the support track 24 on the other side of the side member 20. In this manner, each side member 20 is a modular component which can be used as a right or left hand side of a series of shelves or racks, and could also be used intermediate the sides of a rack 10 as shown in FIGS. 1 and 6. In the preferred embodiment of FIGS. 1, 5, and 6, three levels of support tracks 22 and 24 are provided. However, one of ordinary skill in the art may use fewer or more sets of tracks depending on the number of cans or other similar containers to be dispensed. Similarly, the length of each support track 22 or 24 depends on the number of cans which the rack 10 is designed to accommodate.

Figure 3:
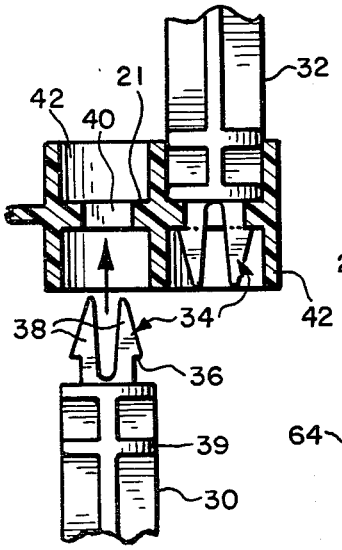
FIG. 3 is an exploded top cross-sectional view of the storage and dispensing rack of FIG. 2 taken along line 3—3, showing the interrelationship of interconnecting rods with apertures in the side member.
Figure 2:
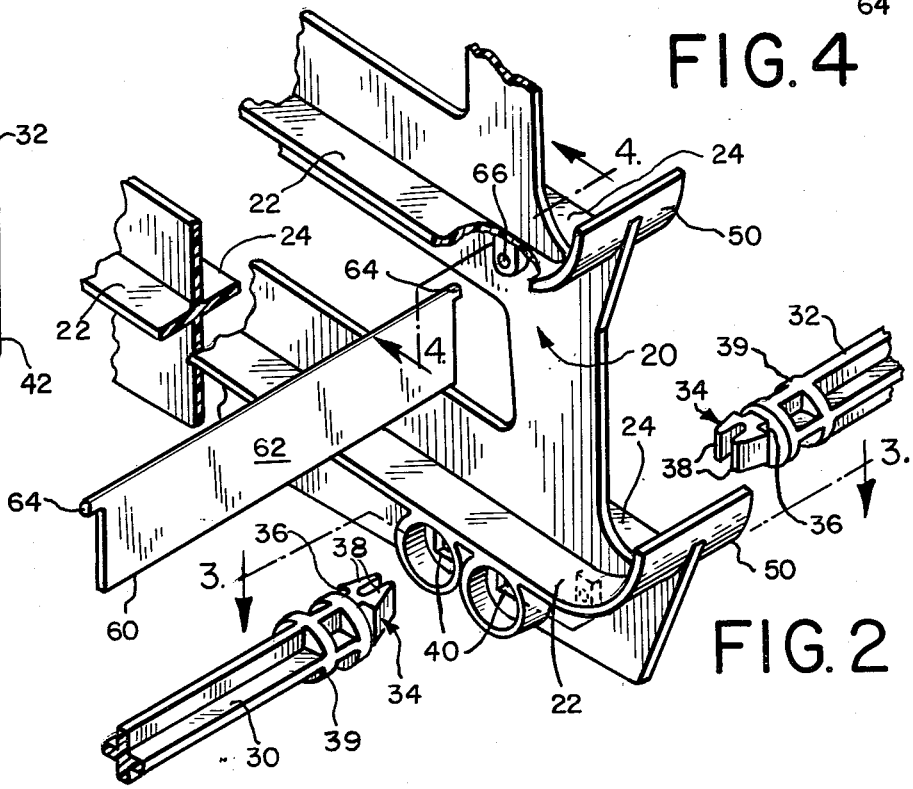
FIG. 2 is an enlarged, exploded perspective view of a portion of the middle side member and related elements of the storage and dispensing rack of FIG. 1.

As shown in FIGS. 2, 3 and 6, the rods 30 and 32 hold the side members 20 together to create the rack 10. Each side member 20 has five sets of paired apertures 40 for receiving the rods 30 and 32. The portion of the rack 10 that accommodates the shorter cans 12 is constructed with five short rods 30, in the illustrated preferred embodiment being about five inches long, exclusive of the tip portion generally indicated by reference number 34. These tip portions 34 consist of two forked pieces 38 that can be compressed so that the forked tip 34 fits into the corresponding aperture 40. When fully inserted into the aperture 40, the tapered, forked end 34 has a shoulder portion 36 that cooperates with the side member 21 adjacent an aperture 40 to secure the rod 30 within the aperture 40.

As is clear from the drawings, long rods 32 are inserted in aperture 40 in the same manner as short rods 30. The difference is that the long rods 32, when attached to side members 20, provide a shelf area of greater width to accommodate the taller cans 16. The long rods 32 are about six and one-half ($6\frac{1}{2}$) inches long in the illustrated preferred embodiment, exclusive of the tapered tip portion 34. One of ordinary skill in the art may provide additional sizes of rods 30 or 32. For instance, it is known that the standard 12-ounce soft drink can is about one-half ($\frac{1}{2}$) inch shorter than the standard 12-ounce beer can. Therefore, a third size of rods may be provided to produce a shelf area of appropriate width for the particular 12-ounce can to be used in the system. For instance, if 12-ounce soft drink cans, 12-ounce beer cans, and 16-ounce beer cans are to be stored in the same storage rack 10, three sets of rods would be provided, a set of first rods (not shown) shorter than the short rod 30, a set of short rods 30, a set of long rods 32. Also, a fourth set of rods (not shown) having a length of about three and one-half inches, exclusive of the tip portions, may be used to provide a shelf area for 8-ounce cans. It is contemplated that rods of other lengths may also be provided to accommodate additional can sizes.

When each rod 30 or 32 is positioned at the aperture 40 with its tapered end 34 therein, the rod 30 or 32 is additionally supported by a flange 42 extending from the side member 20 adjacent the aperture 40. For additional strength, but lightweight structure, the rods 30 and 32 are of a generally cruciform cross-sectional shape, and additionally have a bearing surface 39 so positioned as to rest on the flange 42 when the rod is fully inserted within the aperture 40.

In order to provide a rack which displays and dispenses cans for removal, but does not permit them to freely roll off the shelves provided by the support tracks 22 and 24, a front stop 50 and a rear stop 52 are provided at each support track combination 22 and 24. The front stop 50 permits each can 12 or 16 to be retained, displayed, and easily accessible to a user. The rear stop element 52 permits cans from falling from the rear of the rack 10 when it is being loaded from the front.

Figure 4:
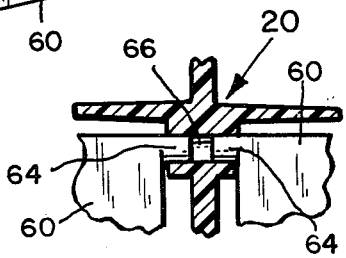
FIG. 4 is a cross-sectional view of a portion of the storage and dispensing rack of FIG. 2 taken along line 4—4, showing portions of two identifying flaps in pivotal engagement with a side member.

A further feature of the present invention, as particularly shown in FIGS. 2 and 4, is an identification flap 60 located beneath the shelf area provided by support tracks 22 and 24 to identify the type of product or brand name of the product in the cans in the shelf area immediately above the identification flap 60. This flap has a face 62 on which the identification, such as brand name, can be applied. The flap 60 is connected to a support member 20 by inserting a pin 64 into the aperture 66 of a support member 20. In this manner each flap 60 is swingably connected to the side members 20, so that a consumer, upon reaching for a can 12 or 16, may move the flap 60 out of the way and firmly grasp the cylindrical face of the can 12 or 16.

In operation, when a user removes a can 12 or 16, the remaining cans or like containers roll forward placing another can in the proper dispensing position. The side member 20 and rods 30 and 32 may be easily manufactured from plastic by various molding and/or stamping techniques. Of course, other material such as metals, reinforced paperboard or cardboard, may also be employed in the construction of the rack 10. It is apparent that the number of components required to produce the rack 10 is small, and the only large components of the side members 20, thus permitting the disassembled rack to be stored or shipped in a rather compact arrangement. The lightweight identification flaps 60 clearly identify the product in the adjacent shelf area at the forward end of the shelf tracks 22 and 24, the position at which a can or like container is typically removed by a consumer or other user.

It should be understood that various changes and modifications to the preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

We claim:

1. A rack for storing and dispensing individual containers of generally cylindrical shape, said rack comprising:

at least two identical side members, each side member having a plurality of apertures in paired, adjacent relationships, each side member further having a plurality of pairs of support tracks, each pair having a support track on either side of said side member at the same vertical location; and a plurality of rods, each end of each rod being removably received by a separate one of said adjacent pair of apertures so that said rods interconnect said side members at a plurality of locations whereby said support tracks cooperate to support the containers along an incline.

2. A rack for storing and dispensing individual containers of generally cylindrical shape, said rack comprising:

at least three identical side members, each side member including a plurality of apertures in paired, adjacent relationships and a plurality of pairs of support tracks, each pair having a support track on either side of said side member at the same vertical location;

a set of first rods, each end of each of said first rods being removably received by a separate one of said adjacent pair of apertures so that said set of first rods interconnect two of said side members at a plurality of locations whereby said support tracks cooperate to support first containers along an incline; and a set of second rods, each second rod being longer than each said first rod and each end of each of said second rods being removably received by a separate one of said adjacent pair of apertures so that said second rods interconnect one of said first two side members and a third side member at a plurality of locations whereby said support tracks cooperate to support containers taller than said first containers along an incline.

3. The storage and dispensing rack of claims 2 or 1 wherein at each said aperture there is provided a flange extending from said side member for guiding and supporting said associated rod.

4. The storage and dispensing rack of claims 2 or 1 wherein each said rod is provided with tapered ends having shoulder portions so that when a tapered end is inserted into an aperture, said shoulder portions cooperate with a portion of said side member adjacent the aperture to removably secure said rods within said aperture.

5. The storage and dispensing rack of claim 4 wherein each said tapered end is forked.

6. The storage and dispensing rack of claim 5 wherein each of said rods is of a generally cruciform cross-sectional shape.

7. A rack for storing and dispensing individual containers of generally cylindrical shape, said rack comprising: at least three identical side members, each side member including a plurality of apertures in paired, adjacent relationships and a plurality of pairs of support tracks, each pair having a support track on either side of the side member at the same vertical location, each support track being inclined and provided with a means for retaining said containers at a lowermost end of said incline;

a set of first rods, each end of each of said first rods being removably received by a separate one of said adjacent pair of apertures so that said first rods interconnect two of the side members at a plurality of locations whereby said support tracks cooperate to support first containers; and a set of second rods, each second rod being longer than each said first rod and each end of said second rods being removably received by a separate one of said adjacent pair of apertures, said second rods interconnecting one of said first two side members and a third side member at a plurality of locations whereby said support tracks cooperate to support containers taller than said first containers.

8. The storage and dispensing rack of claim 7 wherein each said support track is also provided with a rear stop means.

9. The storage and dispensing rack of claim 7 further comprising at least one identification flap connected to said side members beneath a pair of support tracks.

10. The storage and dispensing rack of claim 9 wherein said flap is swingably connected to said side members.

11. A rack for storing and dispensing individual containers of generally cylindrical shape, said rack comprising;

at least four identical side members, each side member including a plurality of apertures in paired, adjacent relationships, a plurality of pairs of support tracks, each pair having a support track on either side of said side member at the same vertical location, each support track being inclined and provided with a means for retaining said containers at a lowermost end of said incline;

a set of first rods interconnecting two of said side members, each end of each of said first rods being separately received by one of said pair of adjacent apertures at a plurality of locations whereby said support tracks cooperate to support first containers;

a set of second rods, each second rod being longer than each said first rod, said second rods interconnecting one of said first two side members and a third side member, each end of each of said first rods being separately received by one of said pair of adjacent apertures at a plurality of locations whereby said support tracks cooperate to support second containers taller than said first containers; and a set of third rods, each third rod being longer than each of said second rods, said third rods interconnecting one of said first three side members and a fourth side member, each end of each of said first rods being separately received by one of said pair of adjacent apertures at a plurality of locations whereby said support tracks cooperate to support third containers taller than said second containers.

* * * * *

UNITED STATES PATENT AND TRADEMARK OFFICE

CERTIFICATE OF CORRECTION

PATENT NO. : 4,356,923

DATED : November 2, 1982

INVENTOR(S) : Young, et al.

It is certified that error appears in the above-identified patent and that said Letters Patent is hereby corrected as shown below:

Cover page, right hand column, line 7, delete "3,306,688 2/1967 Domenico ..... 312/42" and insert --3,306,688 2/1967 Di Domenico ..... 312/42--.

Column 5, line 65, please start a new paragraph beginning with the words "at least three . . ."

Signed and Sealed this

*Thirteenth* Day of *December 1983*

[SEAL]

*Attest:*

GERALD J. MOSSINGHOFF

*Attesting Officer*

*Commissioner of Patents and Trademarks*